United States Patent [19]

Halstead

[11] 4,222,526

[45] Sep. 16, 1980

[54] GAS BURNER

[75] Inventor: Christopher Halstead, London, England

[73] Assignee: Main Gas Appliances Limited, London, England

[21] Appl. No.: 2,133

[22] Filed: Jan. 9, 1979

[30] Foreign Application Priority Data

Jan. 11, 1978 [GB] United Kingdom ..... 1106/78

[51] Int. Cl.[2] ..... B05B 1/14

[52] U.S. Cl. ..... 239/556; 29/513; 239/600

[58] Field of Search ..... 239/556, 565, 543, 568, 239/553, 545, 558, 600; 431/349; 29/513, 509

[56] References Cited

FOREIGN PATENT DOCUMENTS 278729 10/1964 Australia ..... 239/568

1513330 10/1966 France ..... 239/552

*Primary Examiner*—Robert B. Reeves

*Assistant Examiner*—Gene A. Church

*Attorney, Agent, or Firm*—Robert F. O'Connell

[57] ABSTRACT

A burner formed from a sheet metal pressing doubled over to define a gas manifold has alternating flame ports 15 and 16 along one edge. Between the flame ports curled over tabs 19 and 20 define horizontally-directed retention flame ports 21. The tabs 19 and 20 also serve to clamp the edges of the pressing together against the strains of thermal cycling, eliminating the need for spot welding.

4 Claims, 8 Drawing Figures

GAS BURNER

The present invention relates to a gas burner comprising two pressed sheet metal parts assembled face to face to define between them a gas manifold communicating with main flame ports along one edge of the assembled pressings and with retention flame ports located between the main flame ports. The two parts of the burner can be formed by a single pressing folded over or as separate pressings.

Such burners are usually used as aerated burners in that a jet of gas delivered into the gas manifold entrains air and the air-gas mixture is supplied to the flame ports. To obtain good combustion additional air is usually required, some of which diffuses through the flame surface into the combustion zone and some of which is mixed in as a result of the turbulence created by the sudden expansion of the air-gas mixture as it leaves the main flame ports. To obtain the best possible mixing of extra air in this turbulent exit zone it is desirable to have a high exit velocity. Because this velocity is above the natural flame speed of the air-gas mixture there is a tendency for the main flames to lift off. The retention flames are intended to counteract this lift-off tendency by continually re-lighting the main flames.

A gas burner of this kind is known, for example, from French Pat. No. 1,601,971. In the burner described in that specification the retention flame ports alternate with the main flame ports and open in the same direction but whereas the duct leading from the manifold to each main flame port is convergent to increase the velocity, the duct leading from the manifold to each retention flame port has a restricted neck to control the rate of flow of air gas mixture followed by a divergent passage to reduce the velocity of the mixture. The two parts forming this known burner are secured together along the edge in which the flame ports are formed by means of spot welds.

The process of spot welding adds to the difficulty and expense of manufacture but is necessary to prevent separation of the two parts which might otherwise occur as a result of repeated heating and cooling of the edge of the burner in which the flame ports are formed.

With this known burner construction the retention flames create combustion products which fill the spaces between the main flames and interfere with the partial pressure gradients which control the diffusion of air into the main flames.

In accordance with the present invention a gas burner comprising two pressed sheet metal parts assembled face to face to define between them a gas manifold communicating with main flame ports along one edge of the assembled parts and with retention flame ports located between the main flame ports is characterized by a number of tabs each of which extends from the edge of one of the parts and is curled over to form an open-ended hollow cylinder with its axis substantially parallel to the said edge, the open ends of these cylinders forming the retention flame ports.

Thus with this construction the retention flames are directed towards the roots of the main flames and can be smaller than with the known construction. For both these reasons they cause less interference with the access of air to the main flames.

The curled over tabs can be arranged to clamp the edges of the parts together, thus avoiding the need for spot welding of the parts. In particular it has been found that a construction in which each curled-over tab has an end edge engaging against the outer surface of the opposite part of the burner and the tabs are alternately on one part and on the other part, substantially as in the preferred embodiment which is to be described, will successfully withstand thermal cycling over a long period of time although there is nothing else to hold the parts together along the edge in which the flame ports are formed.

The invention will now be described in more detail with the aid of an example illustrated in the accompanying drawings, in which.

Figure 4:
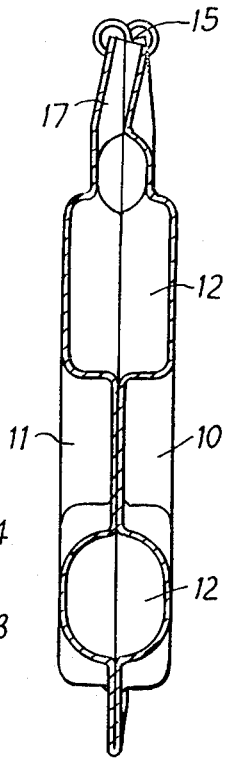
Figure 6:
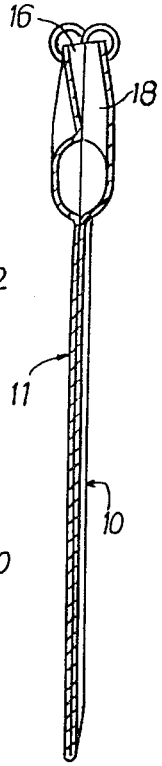
Figure 7:
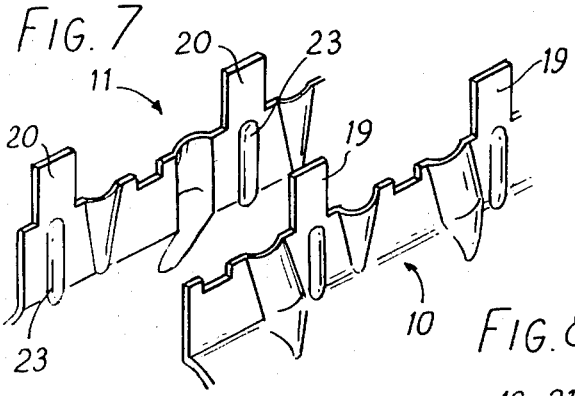
FIG. 7 is a detail perspective of the edges of the two parts of the burner before assembly.

The burner shown in the drawings comprises two pressed sheet metal parts 10 and 11 which are assembled together face to face to define a manifold 12 with an inlet venturi 13 into which a gas jet (not shown) is fitted to direct a stream of gas into the manifold 12. Air orifices 14 facilitate the entrainment of air into the gas stream. From the manifold 12 the resulting air-gas mixture flows to main flame ports 15 and 16 which alternate along the top edge of the burner and are inclined away from one another as can be seen in the sections of FIGS. 4 and 6. These Figures also show how the ports 15 and 16 communicate with the manifold 12 through inclined passages 17 and 18, respectively, which are formed by cooperating channels in the parts 10 and 11.

Figure 1:
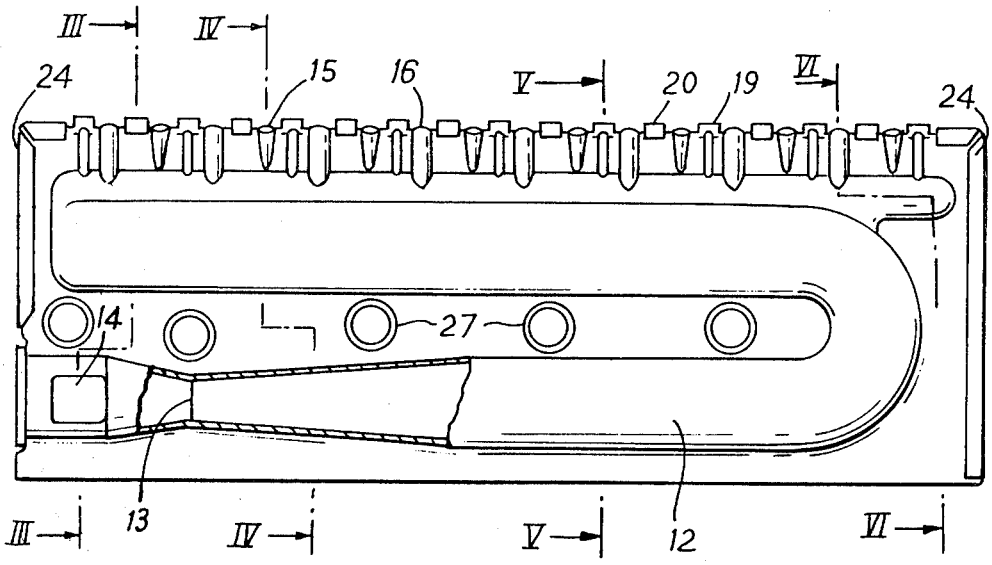
FIG. 1 is a side view of a burner in accordance with the invention.
Figure 2:
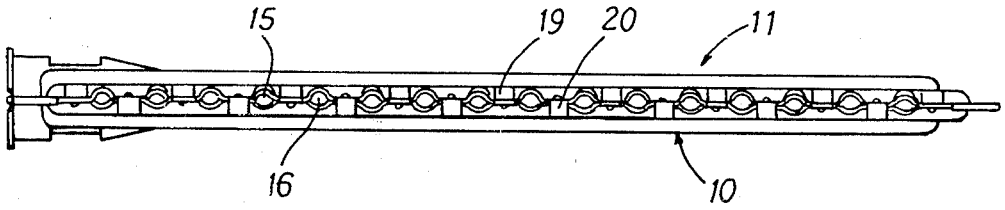
FIG. 2 is a top view showing the main flame ports.
Figure 3:
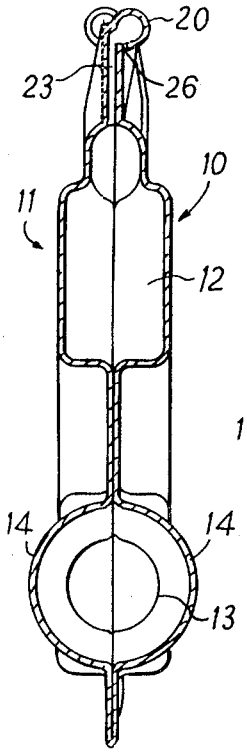
FIGS. 3, 4, 5 and 6 are sections on the lines III—III, IV—IV, V—V, and VI—VI, respectively, of FIG. 1.
Figure 5:
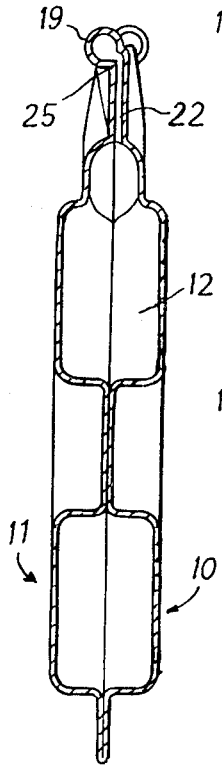
Figure 8:
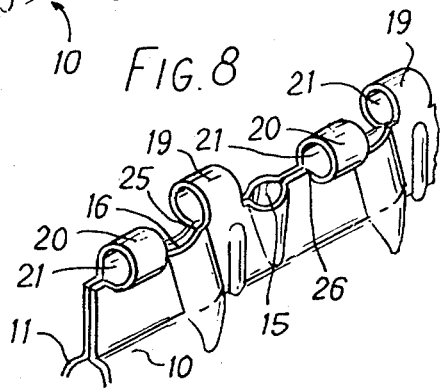
FIG. 8 is a corresponding detail perspective following assembly.

Between each main flame port 15 and an adjacent port 16 there is a tab 19 or 20 which is curled over to form a hollow cylinder with open ends forming retention flame ports 21 (seen most clearly in FIG. 8). The tabs 19 are formed on the part 10 and the tabs 20, which alternate with the tabs 19, are formed on the part 11. The axes of the hollow cylinders formed by curling over the tabs are parallel to the edges of the parts which define the main flame ports 15 and 16. As seen particularly in the sections of FIGS. 3 and 5 the cylinders formed by the tabs 19 and 20 communicate with the manifold 12 by way of channels 22 and 23, respectively, formed in each case in the part carrying the tab.

Thus with the construction described the main flame emerging from each of the ports 15 and 16 has on each side a retention flame directed from a port 21 into the root of the main flame in a direction perpendicular to the main flame.

The parts 10 and 11 are formed as a single pressing which is folded over to bring the parts together face to face. The parts are held together along their free side edges by flanges 24 which are folded over to embrace the edge of the opposite part. This is not possible along the edge in which the flame ports are formed but here it will be noted that the tabs 19 and 20 engage the outer faces of the opposite parts at 25 and 26 respectively and thus serve to clamp these edges of the parts together.

In addition the parts are held together in the central region by eyelet flanges 27 which are formed on one part and are pressed through openings in the opposite part and turned over to clamp the parts more securely together and minimize leakage of gas between the two arms of the generally U-shaped manifold 12.

I claim:

1. In a gas burner comprising two pressed sheet metal parts assembled face to face to define between them a gas manifold and having main flame ports along one edge of the assembled parts and retention flame ports located between said main flame ports, said flame ports communicating with the gas manifold, the improvement which comprises a plurality of tabs each of which extends from the edge of one of the parts and is curled over to form an open-ended hollow cylinder with its axis substantially parallel to the said edge, the open ends of these cylinders forming the retention flame ports.

2. In the gas burner of claim 1 the further improvement wherein each of said curled-over tabs engages the other of said parts and thereby clamps the edges of the parts together.

3. In the gas burner of claim 2 the further improvement wherein said tabs extend alternately from the two parts and each tab has an end edge which engages the outer surface of the other part.

4. A gas burner comprising a single pressing folded double to form two pressed sheet metal parts assembled face to face to define between them a gas manifold and having main flame ports along one edge of the assembled parts and retention flame ports located between said main flame ports, said flame ports being in communication with said gas manifold, wherein said pressing includes a plurality of tabs each of which extends from the edge of one of the parts and is curled over to engage against the other of said parts and thereby clamp the edges of said parts together, said curled over tabs defining the said retention flame ports, and wherein said parts of said pressing are secured together only by said tabs and by engagement of other elements of each part against the other part.

* * * * *